US007331351B1

(12) United States Patent
Asai

(10) Patent No.: US 7,331,351 B1
(45) Date of Patent: Feb. 19, 2008

(54) WIGS AND METHODS OF WIG MANUFACTURE

(76) Inventor: Teruyoshi Asai, 1018 Narciso Ct., San Jose, CA (US) 95129

( * ) Notice: Subject to any disclaimer, the term of this patent is extended or adjusted under 35 U.S.C. 154(b) by 158 days.

(21) Appl. No.: 11/131,788

(22) Filed: May 18, 2005

(51) Int. Cl.
*A41G 3/00* (2006.01)

(52) U.S. Cl. ..... 132/53

(58) Field of Classification Search ..... 132/201, 132/53–56; 289/1.5, 1.2
See application file for complete search history.

(56) References Cited

U.S. PATENT DOCUMENTS

| | | | | | |
|---|---|---|---|---|---|
| 300,938 | A | * | 6/1884 | Beck | 132/53 |
| 1,740,764 | A | * | 12/1929 | Bong | 132/201 |
| 3,645,276 | A | * | 2/1972 | Chaihyung | 132/201 |
| 3,709,536 | A | * | 1/1973 | Huber | 289/1.5 |
| 3,722,517 | A | * | 3/1973 | Molinario | 132/201 |
| 3,862,638 | A | * | 1/1975 | Fannin | 132/53 |
| 3,968,807 | A | * | 7/1976 | Kraicer | 132/53 |
| 3,970,092 | A | * | 7/1976 | Nelson | 132/201 |
| 4,214,033 | A | * | 7/1980 | Clifton et al. | 442/47 |
| 4,296,765 | A | * | 10/1981 | Bachtell | 132/53 |
| 5,044,382 | A | * | 9/1991 | Ando et al. | 132/54 |
| 5,368,052 | A | * | 11/1994 | Finamore | 132/54 |
| 5,406,971 | A | * | 4/1995 | Taylor | 132/201 |
| 5,531,342 | A | * | 7/1996 | Ueda | 216/7 |
| 5,775,341 | A | * | 7/1998 | Abe et al. | 132/201 |
| 5,853,009 | A | * | 12/1998 | Yu | 132/201 |
| 6,085,755 | A | * | 7/2000 | Loren | 132/53 |
| 6,619,703 | B2 | * | 9/2003 | Dirks et al. | 289/1.2 |
| 6,910,486 | B2 | * | 6/2005 | Makino et al. | 132/201 |
| 2003/0000540 | A1 | * | 1/2003 | Makino et al. | 132/201 |
| 2004/0251688 | A1 | * | 12/2004 | Safwat et al. | 289/1.2 |
| 2006/0000482 | A1 | * | 1/2006 | Van Rooy | 132/53 |

* cited by examiner

*Primary Examiner*—Todd E. Manahan
*Assistant Examiner*—Rachel A. Running
(74) *Attorney, Agent, or Firm*—Robert E. Purvy

(57) ABSTRACT

Methods, apparatuses and systems directed to wigs and manufacturing them. Methods are described in which an attachment fiber, in certain embodiments having adhesive properties, is used to secure the hair to the wig base. In certain embodiments the attachment fiber's outer layer is melted to form an adhesive while the inner layer or layers are not melted and retain their strength. The attachment fiber can then be secured to the wig base in a way which permits the permanent setting of the hair's direction and is less visible than conventional methods at the hairline.

10 Claims, 18 Drawing Sheets

WIGS AND METHODS OF WIG MANUFACTURE

FIELD OF THE INVENTION

The invention relates to wigs and their methods of manufacturing, particularly the methods by which the hair is secured to the wig base. Hair, either human or synthetic, is typically attached to a base by manual or automated methods, usually involving a step in which the hair is tied to one or more fibers of the base.

BACKGROUND OF THE INVENTION

Typically a wig is made by attaching hairs to a "base" or "net", a fabric of some type usually designed to be light and breathable for the wearer's comfort, since it sits directly on the head. Hairs are often attached mechanically by looping the hair around one or more base fibers. FIG. 1 illustrates a method by which a hair 110, human or synthetic, is threaded around the base 100 to form a loop and through the loop to emerge at 120. This method, called a "full tie," relies on mechanical friction created by the loop to secure the hair to the wig base.

There are certain shortcomings of the conventional methods described herein. The "loop" can loosen with time, and if pulled too tightly in order to prevent loosening, the base can be deformed. The use of adhesives is difficult, since the adhesive is difficult to place accurately given the small size of a human hair, and if too much adhesive is used it tends to be visible to the human observer. The direction of the hair also cannot be controlled reliably, and this is important since hair fashions often require hairs on different parts of the head to lie in different directions, as natural hair does. This hair direction, even if set by various styling methods after attachment, may be changed if the hair is disturbed, by wind or a hat for example. If an adhesive of any sort is used to secure the base to the wearer's head, that adhesive may over time pull the hair away from the base.

There are other shortcomings of conventional methods as well: the loop, being larger than the diameter of a single hair 110, can be visible, particularly at the hair line, thus making it obvious that a wig is being worn. In certain conventional manufacturing methods, the base 100 is bleached or colored to match the base, to make it less visible. However, bleaching tends to weaken the hair, and is generally not feasible with most synthetic hairs.

Finally, conventional manufacturing methods are not well adapted to automated manufacturing, and thus often they are performed by human labor. It is desirable to use synthetic hair in an automated manufacturing method since it can be obtained in uniform lengths, unlike human hair which is more variable in length.

In light of the foregoing, there exists a need in the art for improved wigs and methods of manufacturing them. Important needs include setting the direction of the hair to simulate the natural look of human hair, forming a secure and durable yet unobtrusive and natural-looking attachment of hair to base, particularly at the hair line, and allowing for automated manufacturing using natural or synthetic hair without bleaching at the roots.

SUMMARY OF THE INVENTION

The invention provides methods and systems directed to wigs and methods of manufacturing wigs. Methods are described in which one or more attachment fibers, in certain embodiments having adhesive properties, are used to secure the hair to the wig base. In certain embodiments the attachment fibers' outer layer, comprising a plasticizer such as dioctyl phthalate or isophthalic acid-based resin, is melted by being heated at a temperature of 165 to 175 degrees Centigrade for about 0.2 seconds to form an adhesive. The inner layer or layers do not comprise such plasticizers and thus do not melt, thereby retaining their strength. The attachment fibers are thus secured to the hair and the wig base in a way which permits the permanent setting of the hair direction and is less visible than conventional methods. Additionally, the attachment fibers may be used to strengthen the wig base, particularly at the hair line.

DETAILED DESCRIPTION OF PREFERRED EMBODIMENT(S)

In embodiments of the invention, one or more attachment fibers are used to secure one or more hairs to the wig base, or to hold the wig base together. The attachment fiber is of a diameter similar to that of a human hair, and has or is capable of acquiring adhesive properties. In certain embodiments, the attachment fiber is composed of at least two layers, the outer layer or "sheath" having adhesive properties when melted, and having a lower melting point than the inner layer or layers, or "core." In certain embodiments heat is applied to the attachment fibers at one or more points in the manufacturing process, causing the sheath material to flow freely and producing an adhesive which is useful in securing the hairs to the base, securing the hair to the attachment fiber, securing the attachment fiber to the base, and fusing the base joints in order to prevent unravelling. In other embodiments, the base can be made wholly or in part from the attachment fiber.

It should be noted that although some embodiments disclosed herein show one attachment fiber attaching one hair to one fiber of the base, other embodiments are possible. Multiple hairs can be folded together and attached to one or more base fibers, via one or more attachment fibers.

Figure 1:
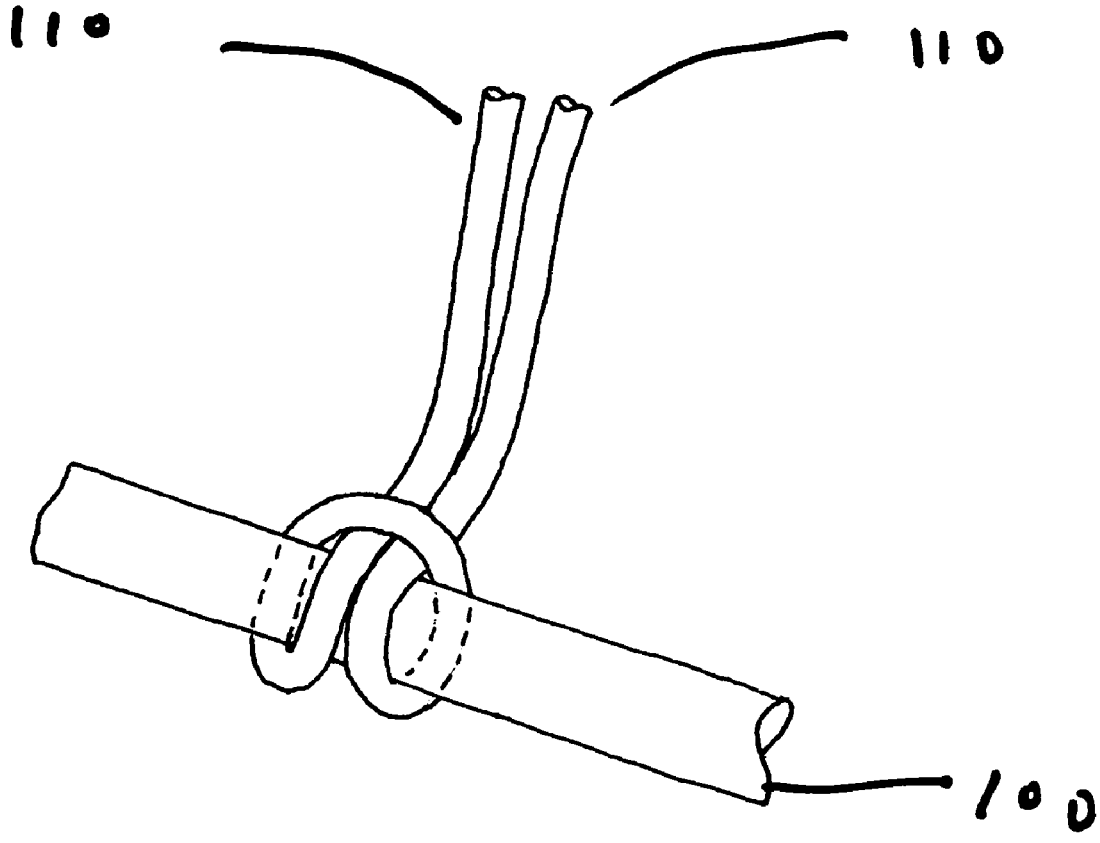
Prior art Figure 1
FIG. 1 is a diagram illustrating a conventional method of attaching hair to a base fiber.
Figure 2A:
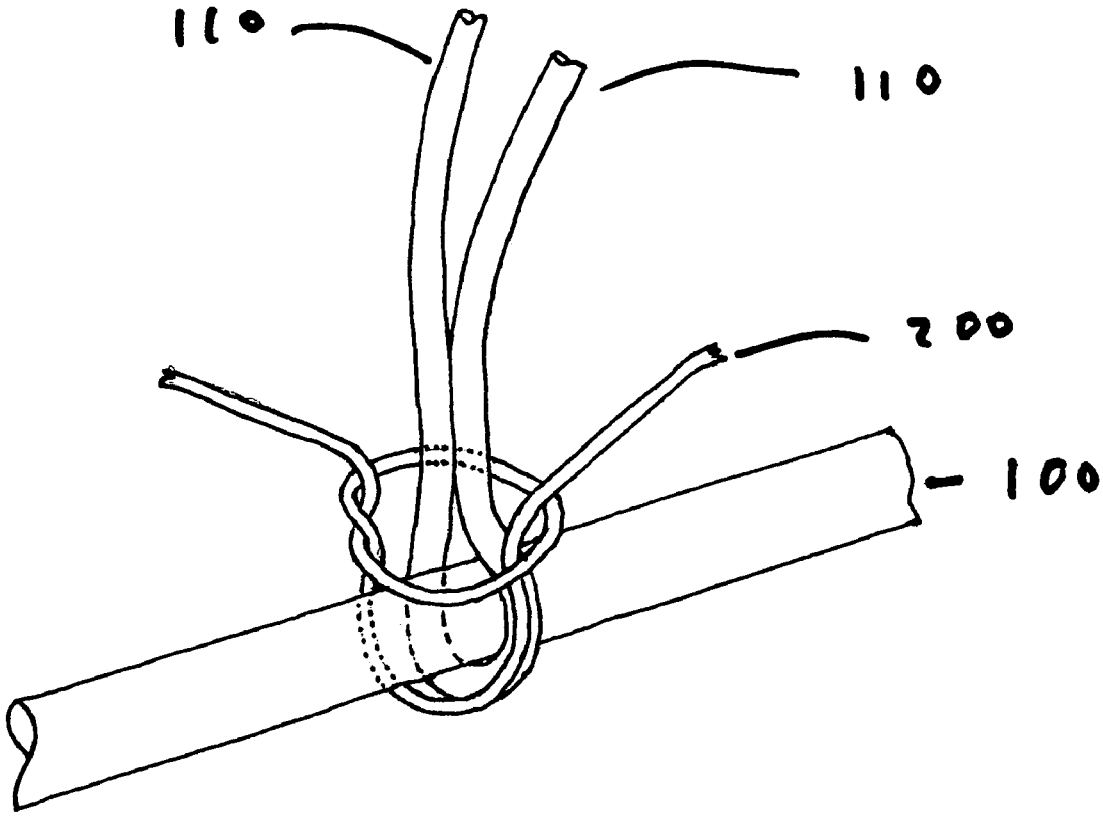
FIG. 2A is a diagram illustrating a side view of a method of attaching hair to a base fiber with attachment fiber, according to one embodiment of the invention.
Figure 2B:
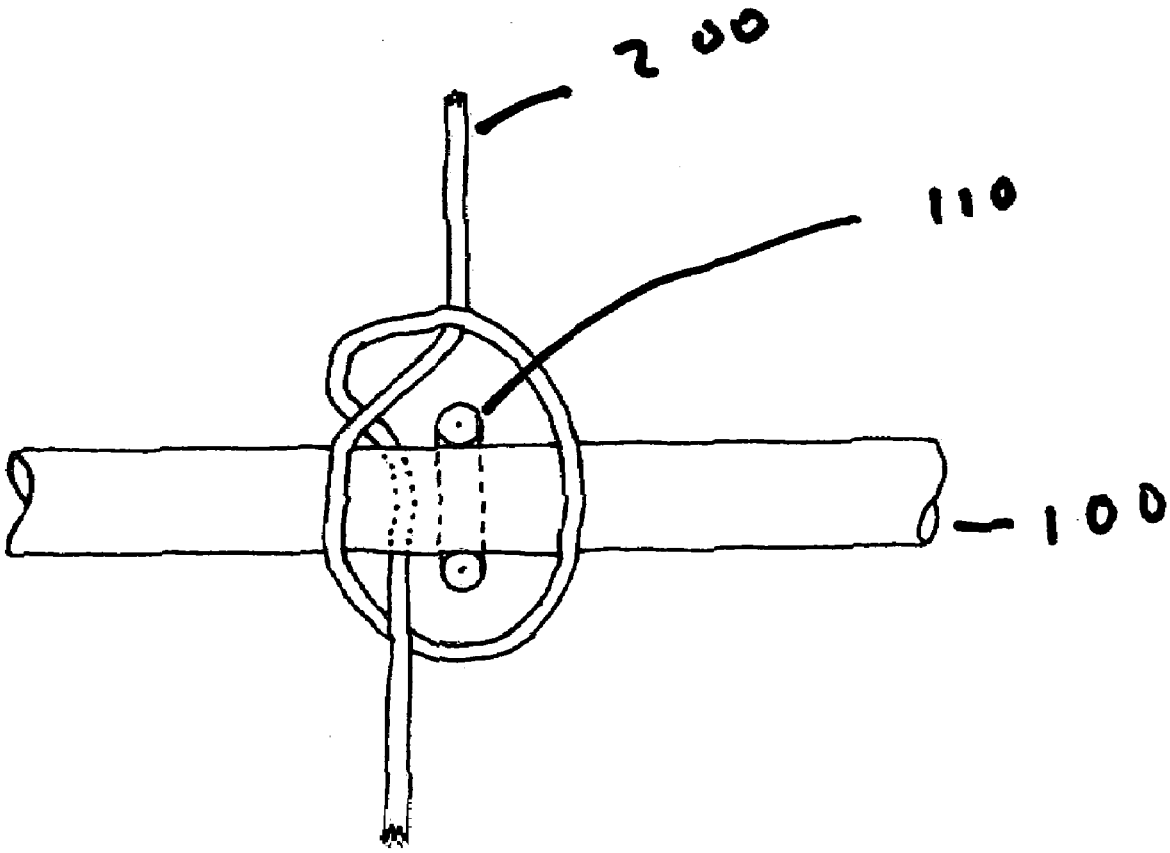
FIG. 2B is a diagram illustrating a top view of the method of FIG. 2A.

FIG. 2A illustrates a side view of one use of an attachment fiber 200 to attach the hair 110 to one or more fibers of the base 100. In this illustration, the hair 110 is simply folded under the base 100 rather than forming a loop as in FIG. 1. An attachment fiber 200 is threaded around the hair 110 and under the base 100 and drawn tight. FIG. 2B illustrates a top view of the same usage, where the hair 110 is folded under the base 100, and the attachment fiber 200 is threaded around the hair 110 and drawn tight.

Figure 2C:
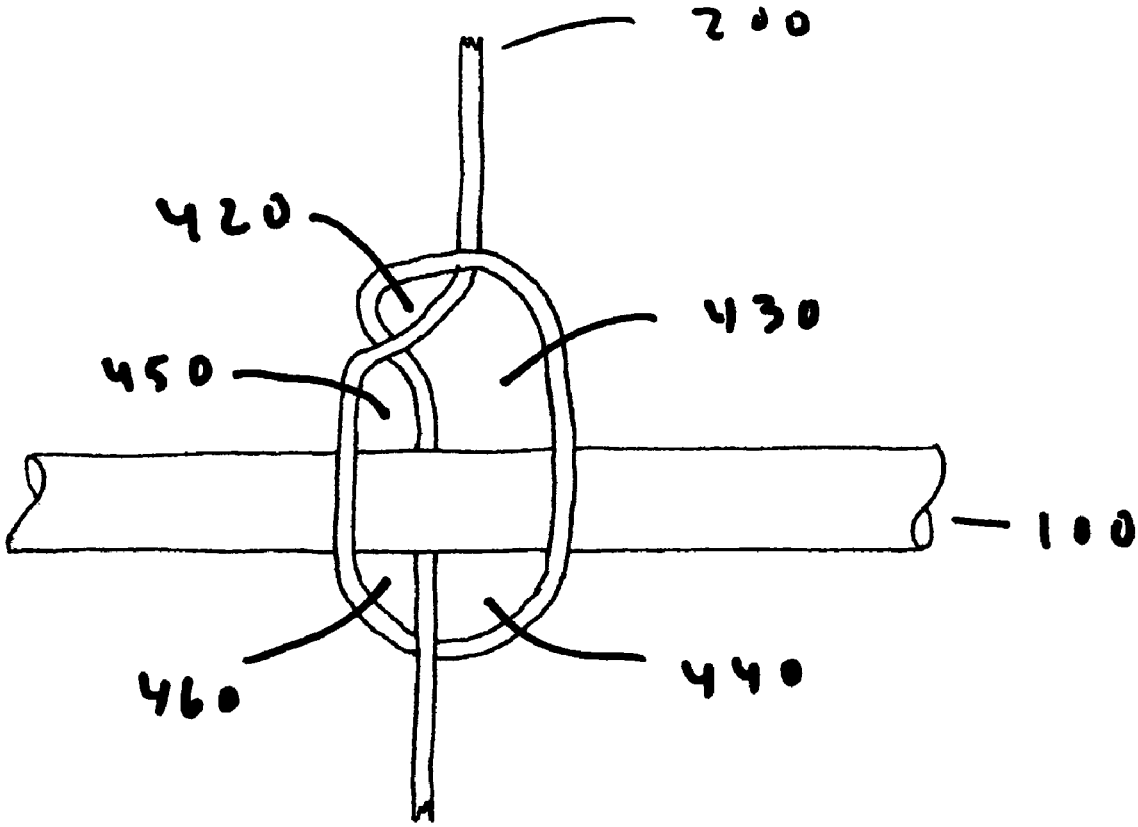
FIG. 2C is a diagram illustrating several possibilities of threading hair through attachment fiber, as in FIG. 2B.

FIG. 2B illustrates one possible method of threading the hair through the loops formed by attachment fiber 200. FIG. 2C illustrates other possible methods of threading the hair. There are five openings 420, 430, 440, 450, and 460 in the attachment fiber 200 formed by its looping around the base 100. The hair can be threaded through any two of these openings. A discussion of some of these possible methods follows:

Threading the hair through the openings 430 and 440 is the method shown in FIGS. 2A and 2B. This method is usable and the hair tends to tilt towards the front.

Threading the hair through the openings 430 and 460 is usable, and the hair tends to be vertical.

Threading the hair through the openings 420 and 440 is usable and the hair tends to tilt to the left.

Threading the hair through the openings 450 and 440 is usable, and the folded half of the hair going through opening 440 tends to be vertical, and the half going through opening 450 tends to tilt to the right.

The aforementioned methods rely on mechanical friction as a method to secure the hair to the base with the attachment fiber. In other embodiments of the invention, the attachment fiber can be of particular types, which have or are capable of acquiring adhesive qualities. These adhesive qualities are useful in forming a more secure attachment of the hair to the base. These types are now described.

In one embodiment, attachment fiber 200 can be comprised of one or more layers having different heating properties, the fiber having an overall diameter similar to that of a human or synthetic hair. In one embodiment, attachment fiber 200 is comprised of an inner material with a relatively high melting point, the "core", and an outer material, the "sheath", with a lower melting point. The sheath, when melted by applying heat above its melting point but below the melting point of the core, forms an adhesive, while the core retains its shape and strength. The adhesive thus formed has a low viscosity and flows freely, solidifying again as it cools, thereby preventing the formation of any lumps of adhesive which would tend to be visible to the human observer. Thus the attachment fiber 200 can be used in the wig manufacturing process in embodiments described herein.

In one embodiment, a fiber has a sheath made of a low fusing point polymer with a melting point of about 160 degrees Centigrade, and a core of a regular polymer with a melting point over 220 degrees Centigrade, with the attachment fiber having a total diameter of about 28 denier or about 50 μm. The core is made of a polymer such as polyethylene terephthalate, and the sheath has plasticizers such as dioctyl phthalate or isophthalic acid-based resin added. Other plasticizers include glycerin or glycerol, sorbitol, triethylene glycol, invert sugar, organic esters of phosphoric acid, vegetable oil plasticizers such as epoxidized soybean oil (ESO), linseed oil, epoxidized tallates, ester-based plasticizers such as stearic and oleic acids, myristic and palmitic acids, and sebacic acids. In one embodiment, a fiber sold by Kanebo, Ltd. under Japanese trademark Bellcouple, type 28/1LCO is used.

The addition of the plasticizers has the effect of lowering the melting temperature and melting viscosity of the sheath, so that when melted it flows freely around the base 100, hair 110, and attachment fiber 200 without forming lumps which would be tend to be visible to the human observer. Heat is applied via a nozzle of a size sufficient to localize the heat to the attachment fiber knot or loop: approximately 0.2 mm inside and 0.5 mm outside diameter.

Although reference is made to melting a polymer including plasticizers in order to form a bond between any two of hair 110, base 100 and attachment fiber 200, or all three, the invention is not so limited. In another embodiment, a fiber having a sheath made of one component of a 2-part adhesive system such as an epoxy could be used, so that when the other component of the epoxy is added, an adhesive is formed. In another embodiment, a drying adhesive containing a solvent could be used on the attachment fiber, wherein the adhesive "sets" as the solvent dries. In still other embodiments, the adhesive could be created by ultrasonics, microwaves, or other types of radiation. It will be apparent to one of ordinary skill in the art that any suitable method of causing an adhesive to spread among hair 110, base 100, and attachment fiber 200 can be used.

Desirable characteristics of the adhesive material used in the invention include its strength, since wig hair can be subjected to forces such as combing or brushing or hand-pulling, or high winds, as in being out in a storm or riding in an open car. The bond formed between any two of hair 110, base 100, and attachment fiber 200, or all three of hair, base, and fiber, should be capable of withstanding normal force exerted by a careful wig owner, keeping in mind that owners may be enjoined not to comb or brush too hard. It has been found that a bond capable of withstanding forces of at least 50 grams per hair is desirable to prevent excessive hair loss during use. Normal hair breaks at a force of 80 to 150 grams, depending on the diameter of the hair, and synthetic hair at a force of about 115 grams. There is little benefit to an adhesive bond stronger than the hair's breaking force.

Figure 3:
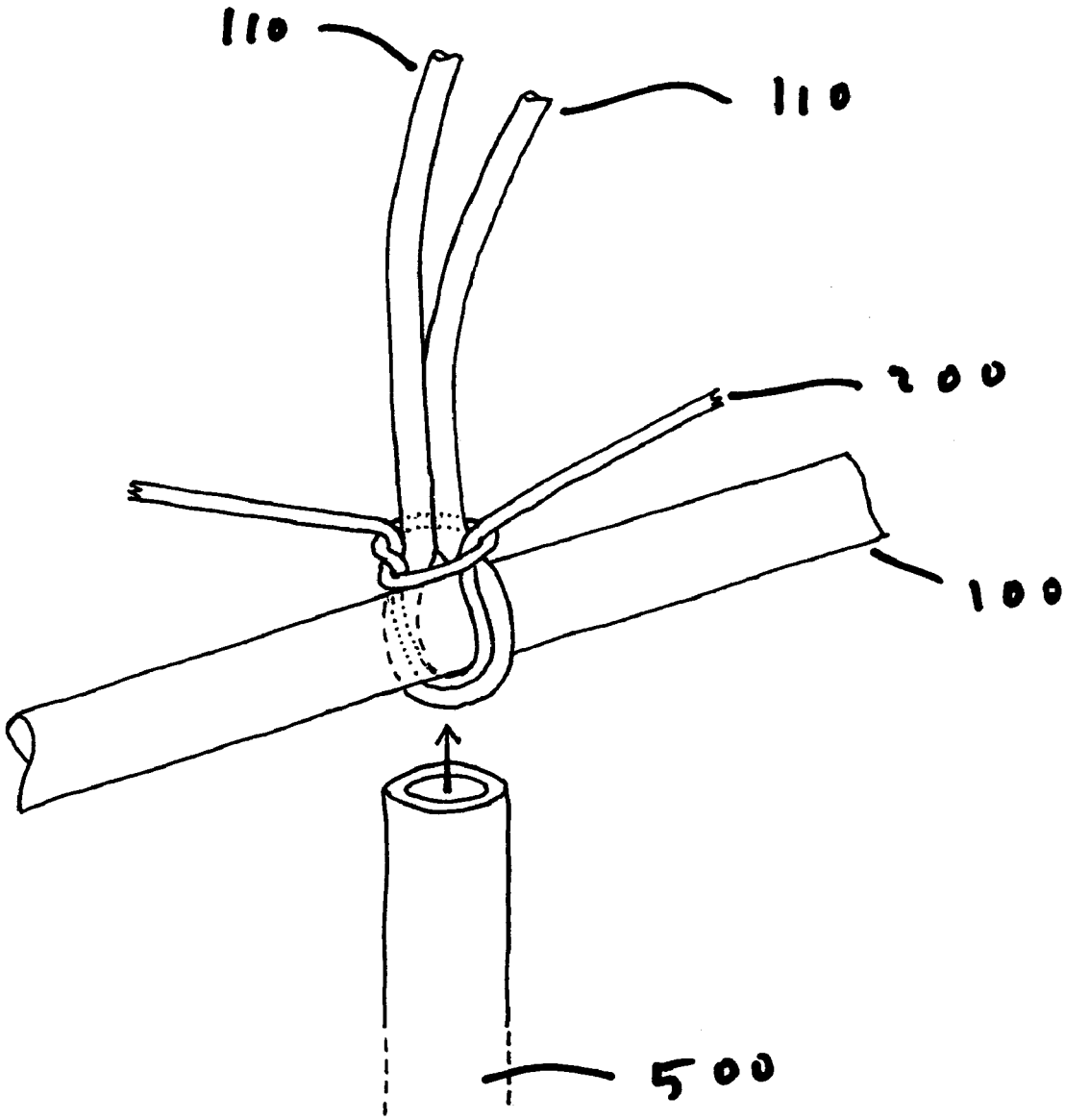
FIG. 3 is a diagram illustrating a method of attaching hair to a base fiber with attachment fiber with addition of heat, according to one embodiment of the invention.

In one method of securing the attachment fiber to the hair and the base, illustrated in FIG. 3, the attachment fiber 200 attaches hair 110 to the base 100 in a manner similar to previously described embodiments. Then heat sufficient to melt the sheath but not the core, from a source 500, is applied to the loops formed by attachment fiber 200, thereby melting the sheath and forming an adhesive, thereby securing the hair 110 to the base 100. In one embodiment, heat is applied at a temperature of 175 to 185 degrees Centigrade, preferably 180, with a duration of 0.4 seconds for the complete heat/cool cycle.

Figure 4:
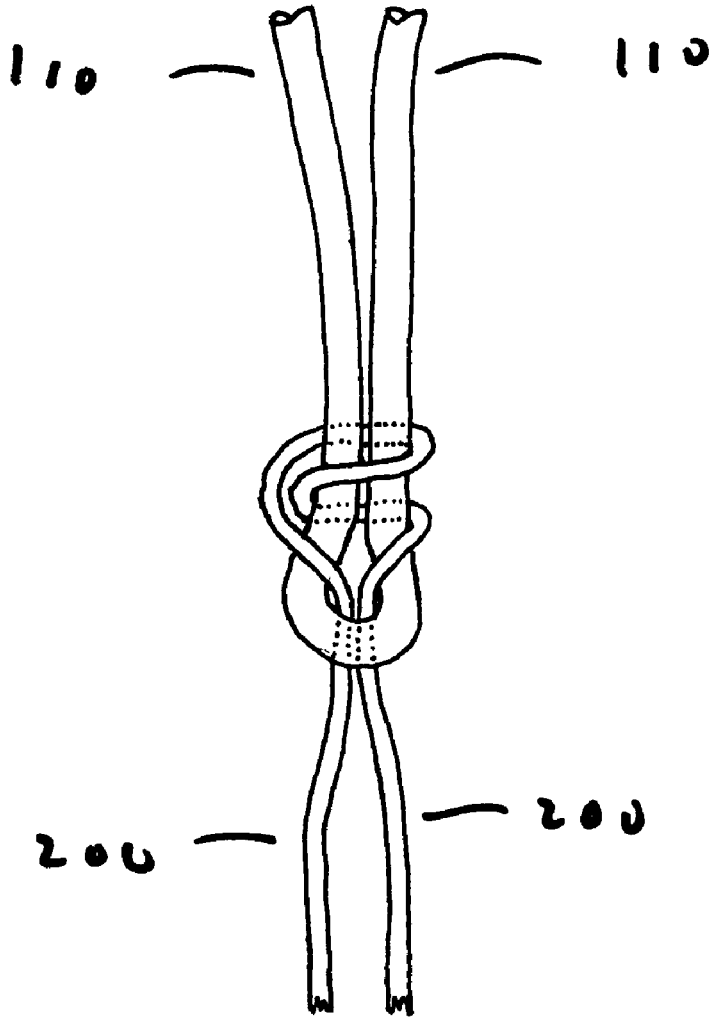
FIG. 4 is a diagram illustrating one method of threading attachment fiber through hair loop, according to one embodiment of the invention.
Figure 5:
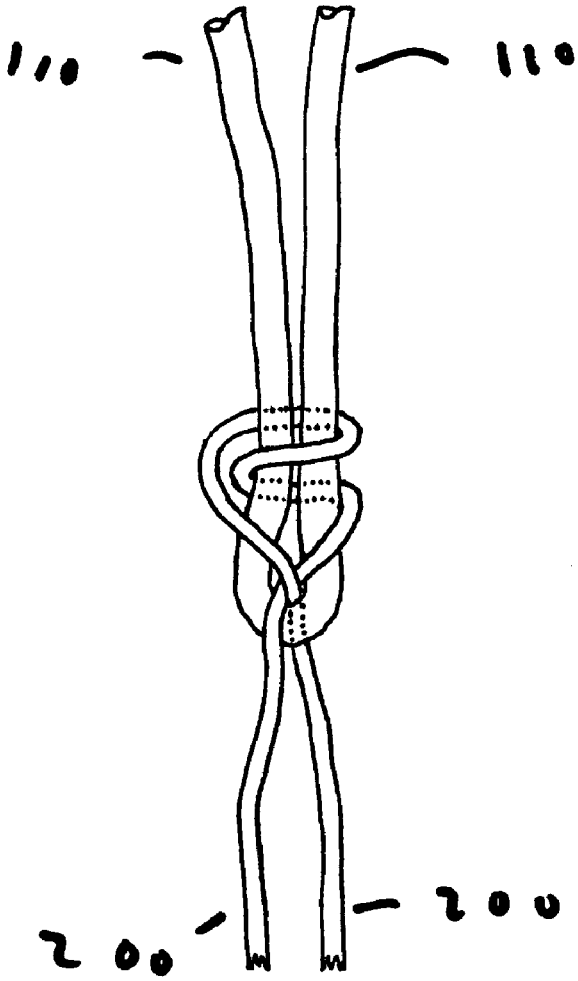
FIG. 5 is a diagram illustrating a second method of threading attachment fiber through hair loop, according to one embodiment of the invention
Figure 6:
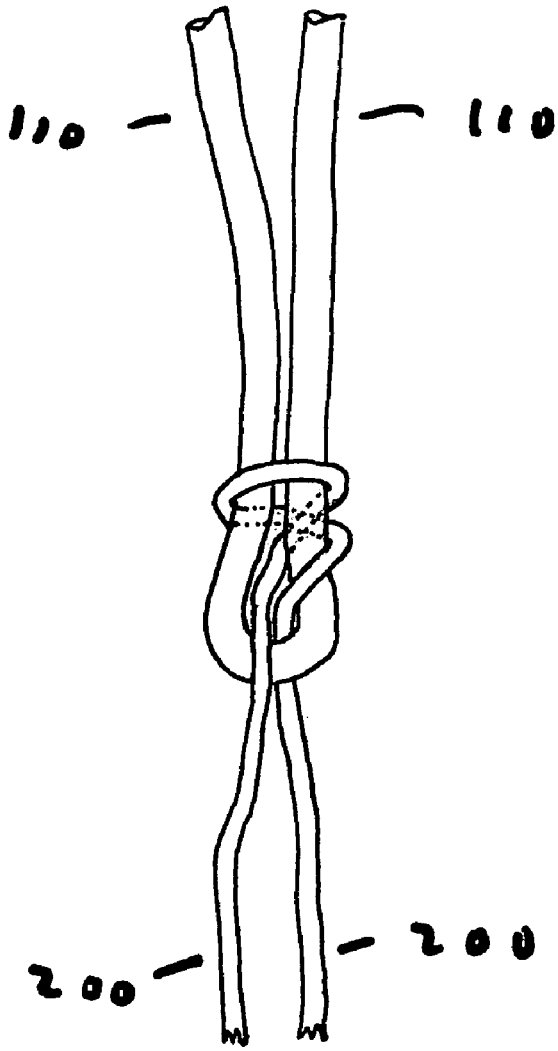
FIG. 6 is a diagram illustrating a third method of threading attachment fiber through hair loop, according to one embodiment of the invention
Figure 8:
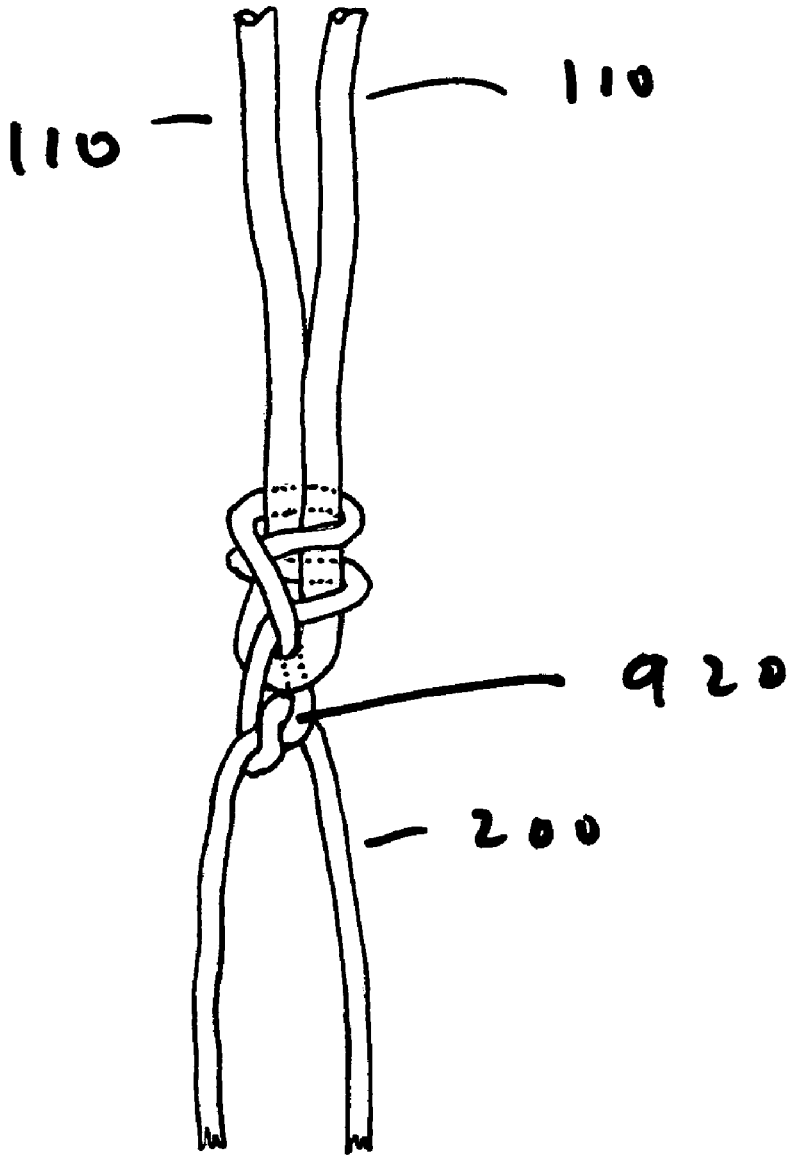
FIG. 8 is a diagram illustrating the formation of a "nut" in attachment fiber under the hair loop, according to one embodiment of the invention.

In another method of securing the attachment fiber to the hair, the attachment fiber is first threaded around the hair fold with its ends exiting the bottom of the fold, as in FIG. 4, 5, or 6, and fused to the hair to make a hair-fiber subassembly. Using any folding method as in FIG. 4, 5, or 6, or another folding method, FIG. 8 illustrates the two halves of the attachment fiber being looped under the fold of the hair at 920, thus forming a "nut". The nut is then fused by formation of adhesive as previously described. The hair-fiber subassembly is then used in further manufacturing steps as described herein.

Figure 7:
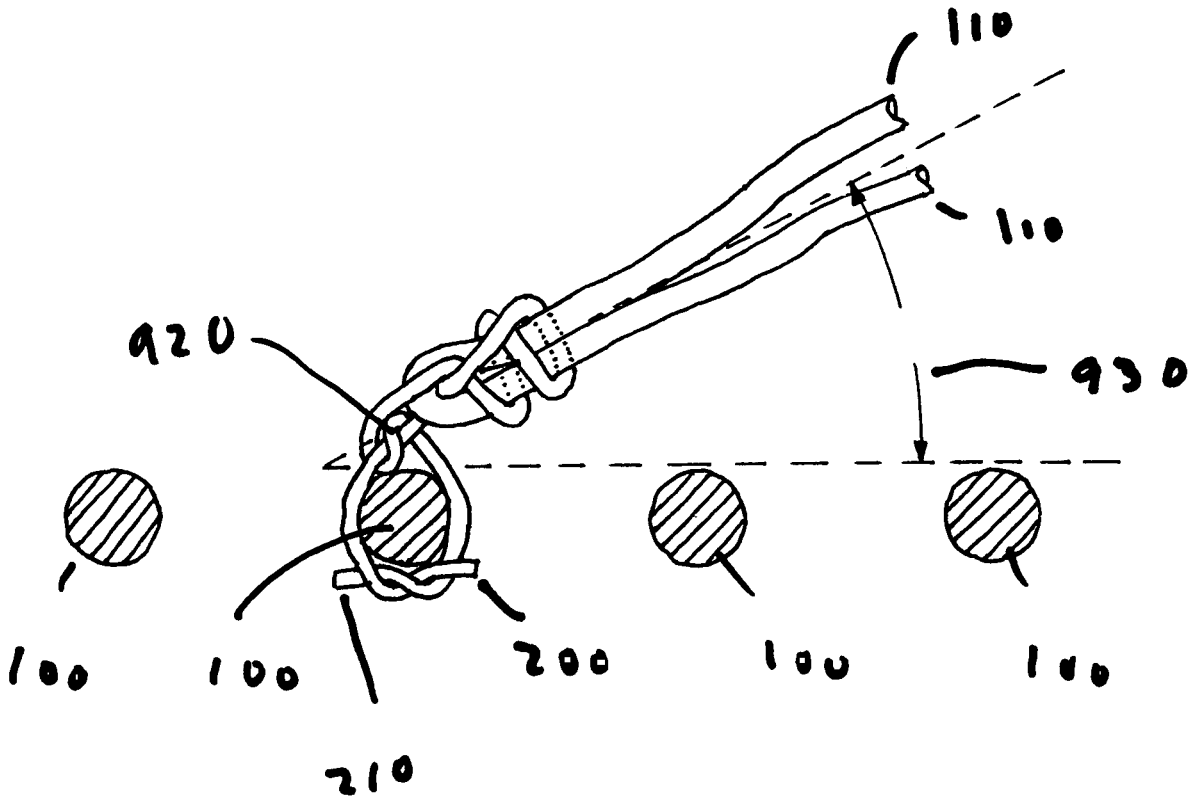
FIG. 7 is a diagram illustrating a method of attaching a hair to a base fiber and setting its direction, according to one embodiment of the invention.

FIG. 7 illustrates the second step of this method, wherein the subassembly of hair 110 and attachment fiber 200 and nut 920 is then attached to the base fibers 100. The direction of the hair, illustrated by the direction line 930, is set and then fixed by the application of heat to the nut 920, which has the effect of re-melting the nut and fusing it to the base. The two ends of the attachment fiber 200 and 210 below the base are then cut. The hair direction is thus set permanently.

Figure 9:
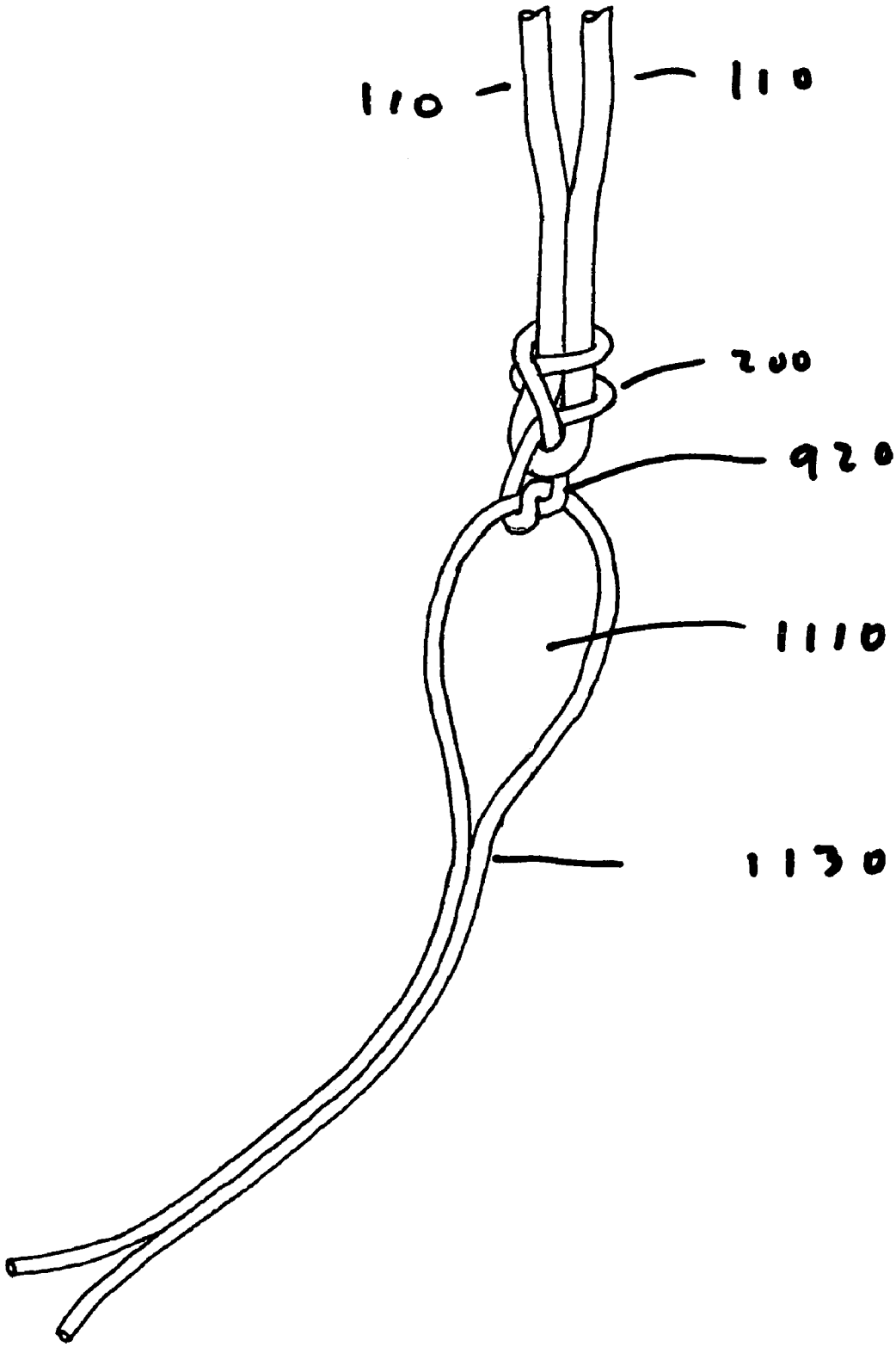
FIG. 9 is a diagram illustrating one step in the manual attachment of a hair to a base fiber with a "nut" and a loop formed in the attachment fiber below the nut, according to one embodiment of the invention.
Figure 10:
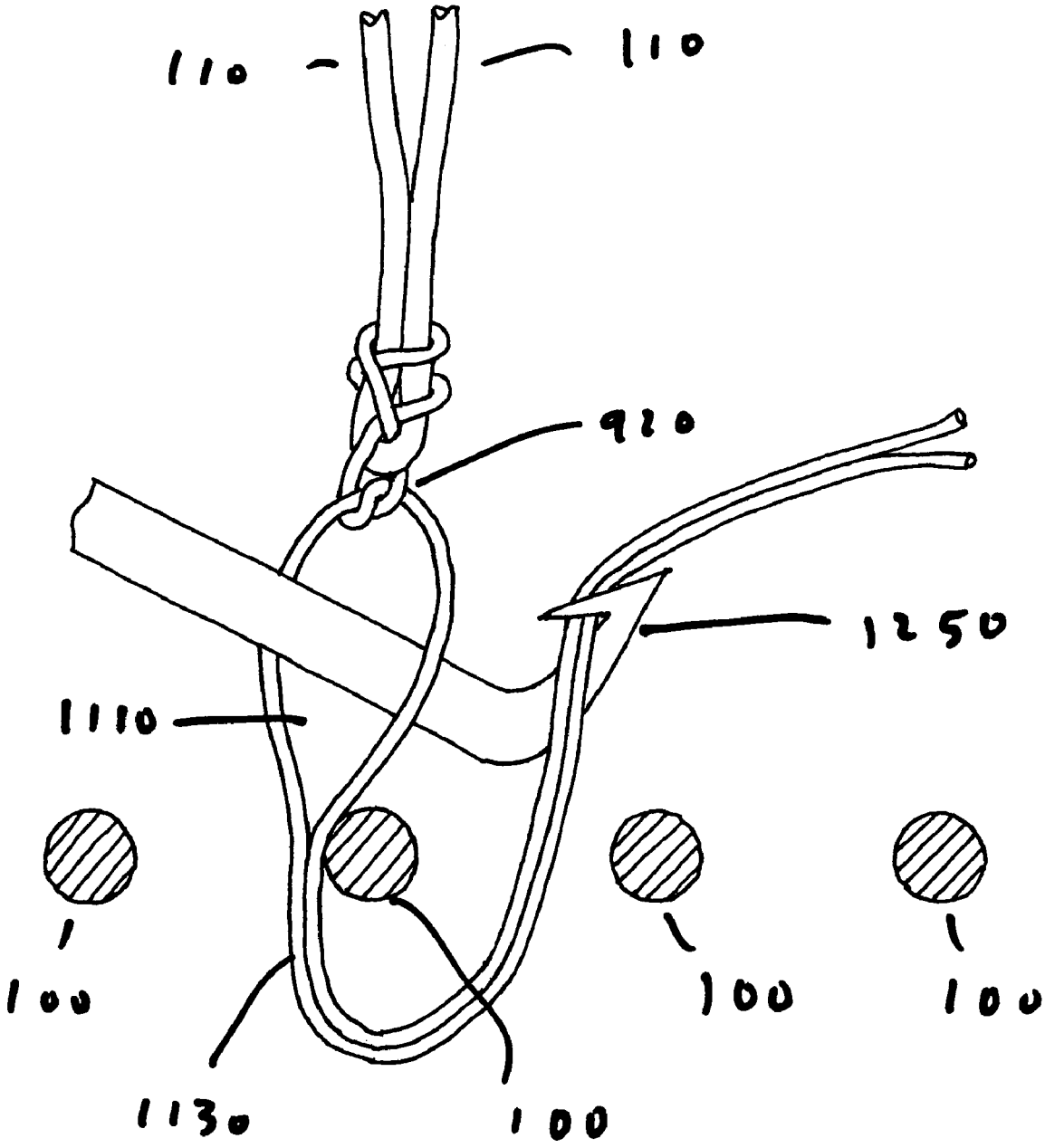
FIG. 10 is a diagram illustrating the final step in the attachment of a hair to a base fiber with a loop formed in the attachment fiber below a nut, according to one embodiment of the invention.
Figure 11:
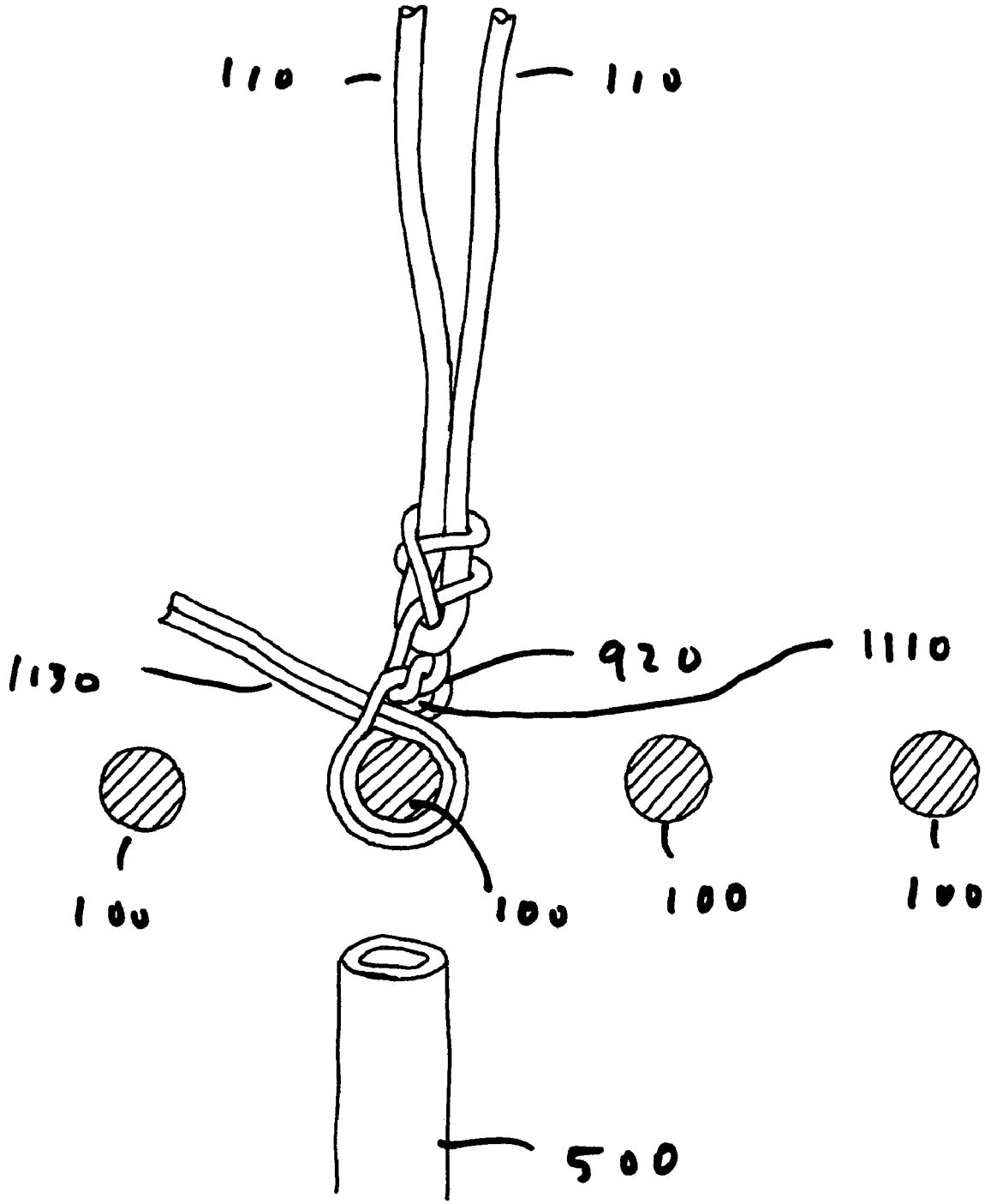
FIG. 11 is a diagram illustrating a complete hair-attachment fiber-base assembly, according to one embodiment of the invention.

In another embodiment, as illustrated in FIG. 9, the attachment fiber 200 is threaded through the hair 110 and a nut 920 formed below the hair, as in FIG. 8. In this embodiment, a loop 1110 is formed in the attachment fiber 200 by fusing it with heat at 1130. This subassembly of hair and attachment fiber may then be attached to the wig base fiber 100 by further steps, as illustrated by FIGS. 10 and 11. Breaking down the attachment process into a step of forming a hair-attachment fiber subassembly, and a subsequent step of securing the subassembly to the base, has advantages for an automated manufacturing method, since there are two simple steps rather than one complex one.

FIG. 10 illustrates the use of the subassembly of hair and attachment fiber formed in FIG. 9. The subassembly is pulled by a tool 1250, which has been inserted in the loop 1110, through the wig base fibers 100. FIG. 11 illustrates the final step in this embodiment, wherein the fused portion 1130 of the attachment fiber 200 is pulled through the loop 1110, and then fused by the application of heat from a source 500. The fused portion 1130 of the attachment fiber 200 is then cut. The method of FIG. 11 is suitable for either manual or automated manufacturing methods.

Figure 13:
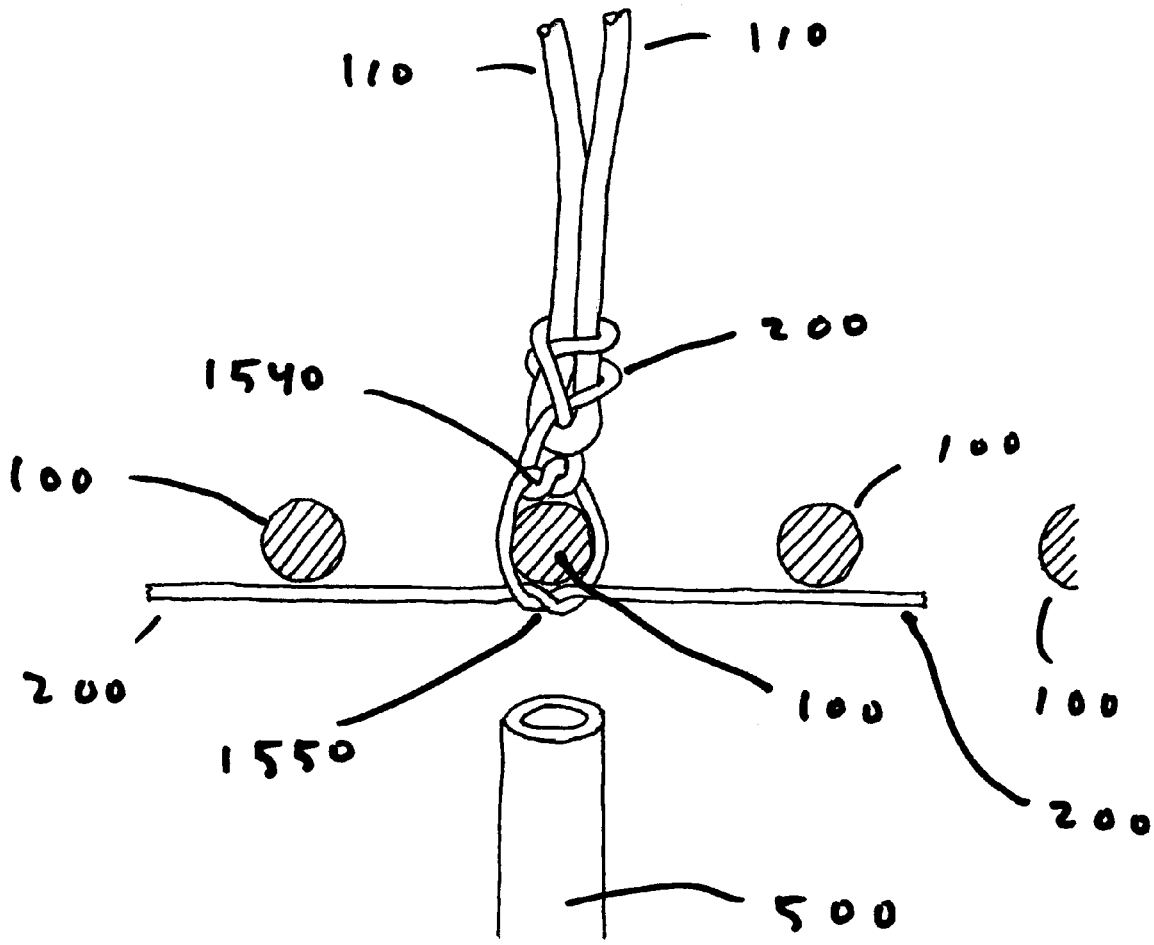
FIG. 13 is a diagram illustrating a complete hair-attachment fiber-base assembly, according to an embodiment of the invention
Figure 14:
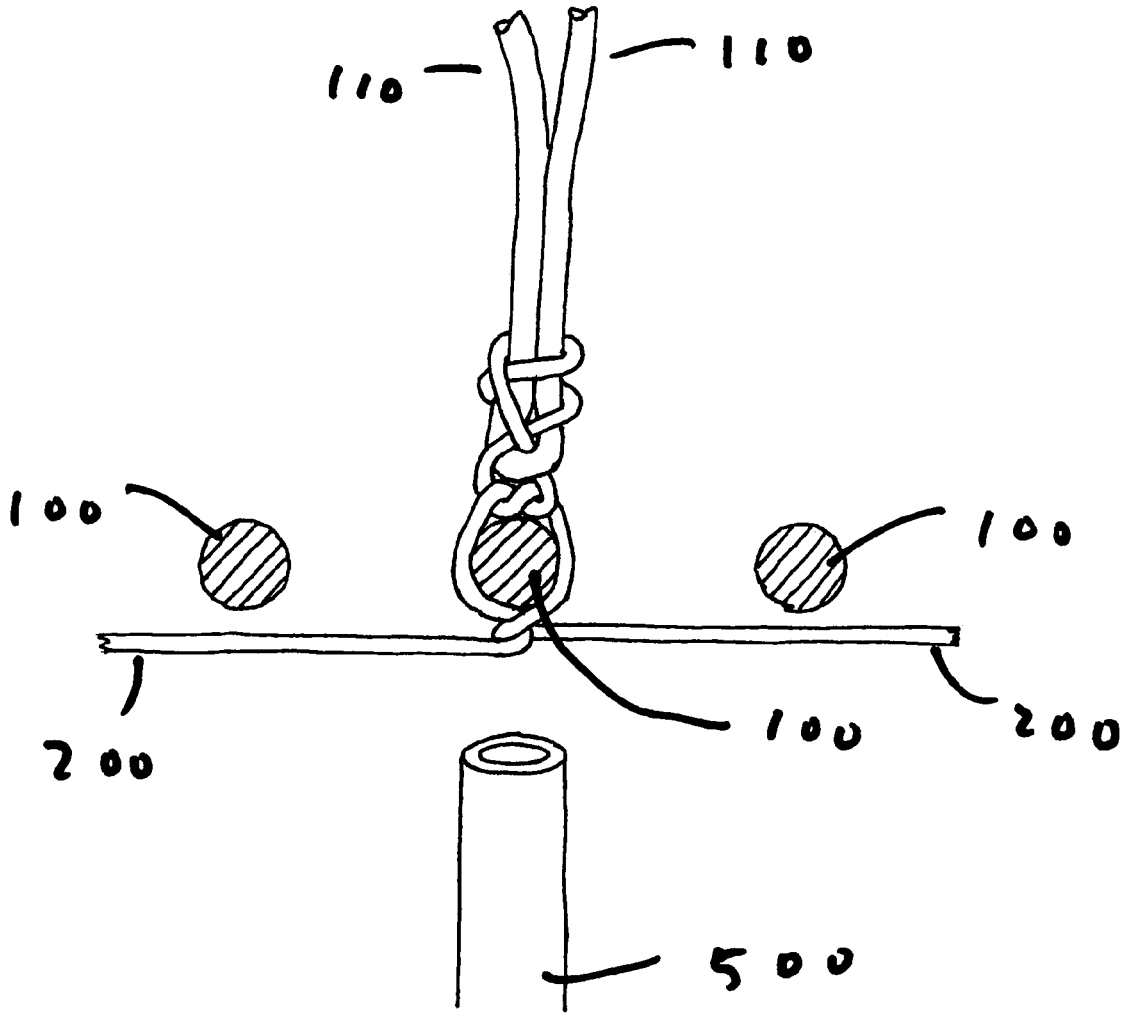
FIG. 14 is a diagram illustrating a complete hair-attachment fiber-base assembly, according to another embodiment of the invention.
Figure 15:
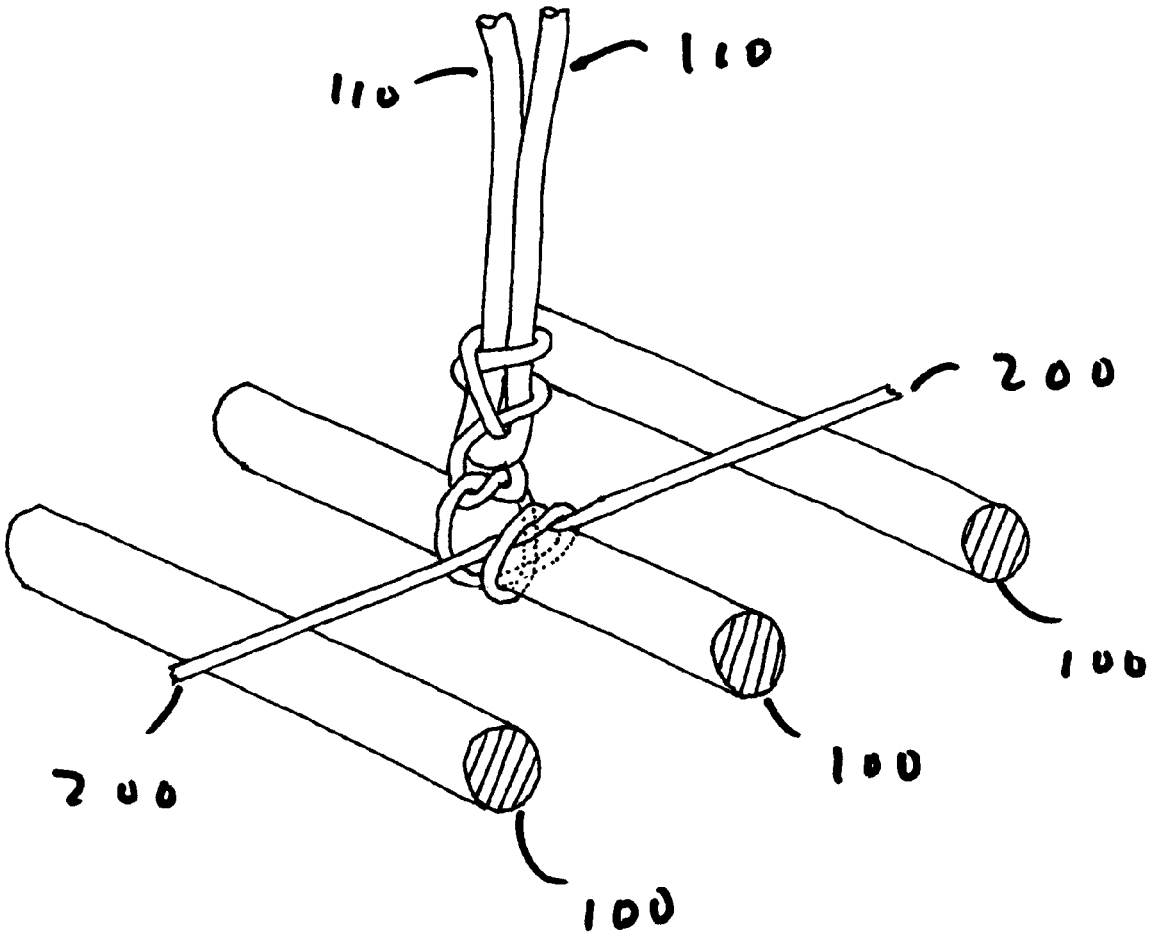
FIG. 15 is a diagram illustrating a complete hair-attachment fiber-base assembly, according to another embodiment of the invention
Figure 16:
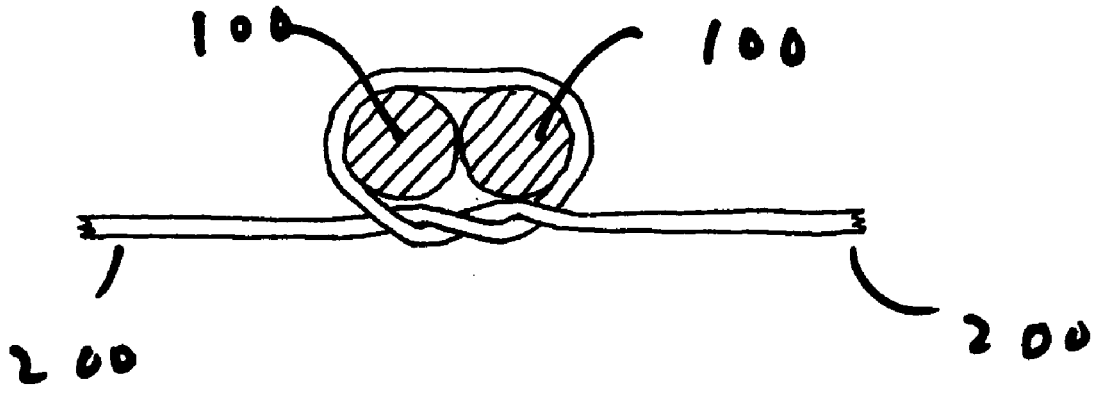
FIG. 16 is a diagram illustrating a complete hair-attachment fiber-base assembly wherein the attachment fiber is wrapped around two base fibers, according to another embodiment of the invention

FIG. 13 illustrates another method of securing attachment fiber to hair and then attachment fiber to one or more base fibers. Attachment fiber 200 is wrapped around hair 110 in a manner described in FIG. 4, 5, or 6, or another manner, and then wrapped around base fiber 100 and knotted at 1550. The attachment fiber is pulled in both directions outward with equal force, so as to avoid pulling the hair in either direction or deforming the base. The hair is pulled in the desired direction, and heat is applied, as previously described, at both 1540 and 1550. Applying heat at 1540 re-melts the "nut" formed when the hair-attachment fiber subassembly was originally formed, and serves to fix the direction of the hair. The attachment fiber 200 is then cut. FIG. 14 illustrates a similar method wherein the two halves of the attachment fiber are not knotted underneath the base fiber but simply crossed. FIG. 15 illustrates another method, wherein the attachment fiber is knotted above the base fiber rather than below it.

Figure 12:
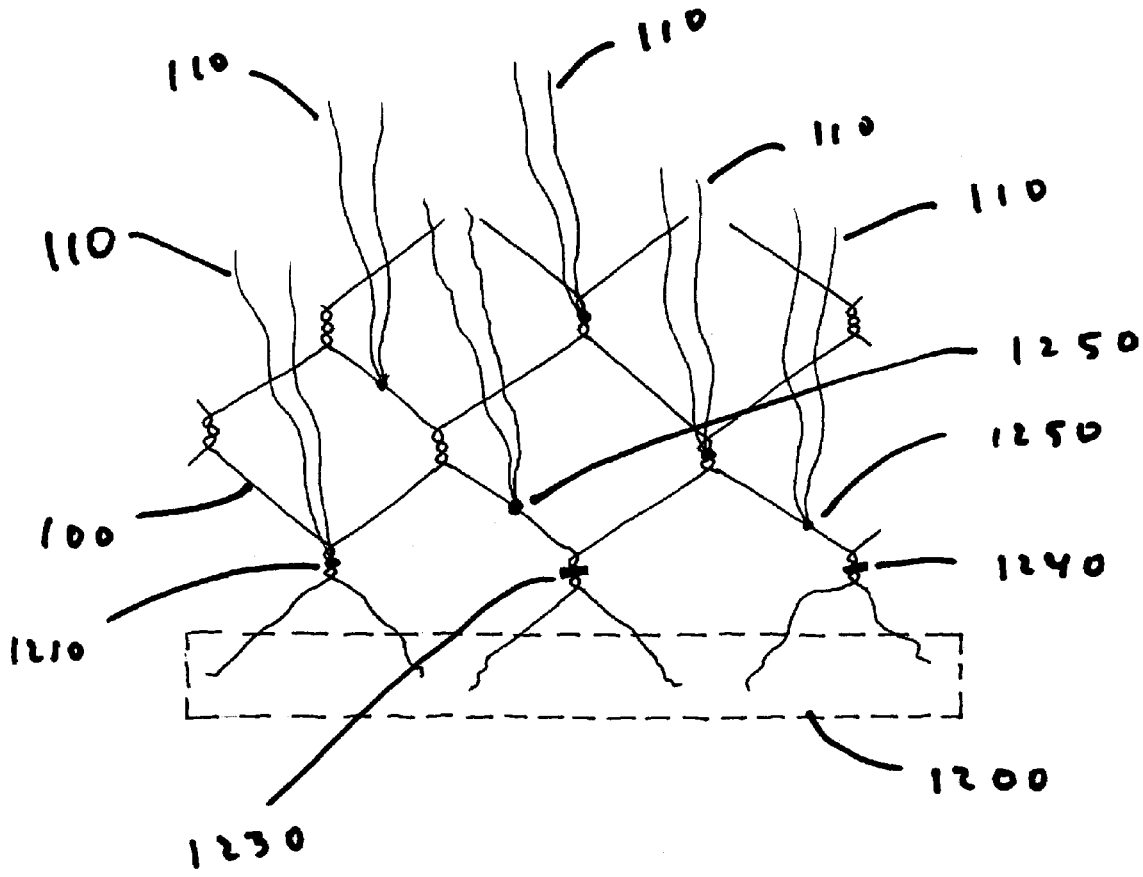
FIG. 12 illustrates the base with hairs attached, and additionally the use of the attachment fiber at joints of the base in order to strengthen it near the hair line.

FIG. 12 illustrates a base with hairs 110 attached to it by any of the methods described herein, at 1250 and 1210. The base is cut to form the hairline at the rectangle 1200, representing the front of the wig, over the wearer's forehead. In the rectangle 1200, the base must be cut and fused or glued in some manner to keep it from unravelling. This is a particularly difficult cosmetic problem, since the hair density at the hairline must be less than in other areas of the head in order to look natural, and thus there is less hair available to obscure the fusing or gluing. In this embodiment, a loop of the attachment fiber is fused to the joints of the base at 1210, 1230, and 1240. Note particularly that no hair is attached at 1230 and 1240; an attachment fiber loop is fused to the joints of the base in order to strengthen those joints and prevent their unravelling, since the base fibers are cut in the rectangle 1200.

Although the invention has been described relative to specific embodiments, it is not so limited. Many modifications and variations of the embodiments described above will become apparent. For example, other fibers or other forms of adhesives may be used. Furthermore, other changes in the details, steps and arrangement of various elements may be made by those of ordinary skill in the art without departing from the scope of the invention. For example, other methods of tying attachment fiber 200 are possible. Accordingly, the invention has been described with reference to specific embodiments. Other embodiments of the invention will be apparent to one of ordinary skill in the art. It is, therefore, intended that the claims set forth below not be limited to the embodiments described above.

What is claimed is:

1. A wig comprising:

a wig base;

hairs, the hairs forming the hairs of the wig;

fibers, the fibers being capable of forming adhesive properties;

one or more of the fibers threaded around one or more of the hairs, the adhesive properties of the fibers causing an attachment of the hairs to the base.

2. The wig as in claim 1, wherein the fibers orient the direction of the hairs.

3. The wig as in claim 1, wherein the base comprises one or more joints, and wherein the fibers are tied to one or more joints in order to strengthen the base.

4. The wig as in claim 1, wherein the fibers are comprised of an outer sheath comprised of a low melting point polymer possessing adhesive qualities when melted, and an inner core comprised of a higher melting point material.

5. The wig as in claim 4, wherein the outer sheath has a melting point of about 160 degrees Centigrade and the inner core has a molting point above 200 degrees Centigrade.

6. The wig as in claim 4, wherein the outer sheath comprises a plasticizer.

7. The wig as in claim 6, wherein the plasticizer comprises dioctyl phthalate.

8. The wig as in claim 6, wherein the plasticizer comprises isophthalic acid-based resin.

9. The wig as in claim 1, wherein:

the hairs are crossed around at least one wig base fiber, thereby forming two parallel halves of each hair on one side of the at least one wig base fiber;

the fibers are threaded around the two halves of the hairs.

10. A wig, comprising:

a wig base;

one or more hair-fiber subassemblies, each comprising:

a hair group comprising one or more hairs, wherein:

the hairs are folded, forming two parallel halves of the hair groups above the fold;

one or more fibers, wherein the fibers are crossed around the two parallel halves of each of the hair groups one or more times, both halves of the fibers then crossing the fold and forming a nut below the fold;

means for fusing the nut; and means for attaching the hair-fiber subassemblies to the base.

* * * * *